US006630919B1

(12) United States Patent
Surguy

(10) Patent No.: US 6,630,919 B1
(45) Date of Patent: Oct. 7, 2003

(54) OPTICAL MODULATOR AND INTEGRATED CIRCUIT THEREFOR

(75) Inventor: Paul William Herbert Surguy, Middlesex (GB)

(73) Assignee: Central Research Laboratories Limited, Middlesex (GB)

( * ) Notice: Subject to any disclaimer, the term of this patent is extended or adjusted under 35 U.S.C. 154(b) by 0 days.

(21) Appl. No.: 09/148,984

(22) Filed: Sep. 8, 1998

(51) Int. Cl.[7] ..... G09G 3/36
(52) U.S. Cl. ..... 345/96; 345/97
(58) Field of Search ..... 345/87, 89, 94, 345/95, 96, 97, 98, 99, 100, 208, 209, 210

(56) References Cited

U.S. PATENT DOCUMENTS

| | | | | |
|---|---|---|---|---|
| 4,655,550 A | | 4/1987 | Crossland et al. | 350/332 |
| 4,773,716 A | | 9/1988 | Nakanowatari | |
| 5,598,177 A | * | 1/1997 | Mizukata et al. | 345/95 |
| 5,612,799 A | | 3/1997 | Yamazaki et al. | 349/42 |
| 5,675,353 A | * | 10/1997 | Tanaka et al. | 345/96 |
| 5,774,102 A | * | 6/1998 | Kanbe et al. | 345/96 |
| 5,867,138 A | * | 2/1999 | Moon | 345/96 |

FOREIGN PATENT DOCUMENTS

| | | |
|---|---|---|
| EP | 0 216 168 | 4/1987 |
| EP | 0 455 233 | 11/1991 |
| EP | 0 549 337 | 6/1993 |
| EP | 0 751 417 | 1/1997 |
| EP | 0 768 561 | 4/1997 |
| GB | 2 233 469 | 1/1991 |
| WO | WO 92/04708 | 3/1992 |
| WO | WO 92/04709 | 3/1992 |
| WO | WO 95/20209 | 7/1995 |

* cited by examiner

*Primary Examiner*—Dennis-Doon Chow
(74) *Attorney, Agent, or Firm*—Crowell & Moring LLP

(57) ABSTRACT

An optical modulator comprises a layer of a ferroelectric liquid crystal material being provided between an integrated circuit and a light transmissive sheet. The light transmissive sheet and the integrated circuit carry respective electrodes which define selected areas of said layer. In use, the selected areas are addressed with data according to an addressing sequence which is repeated in successive time periods. The optical modulator includes means for providing a plurality of voltage pulses to the one or more electrodes being carried by the light transmissive sheet in a given time period, thus enabling a time dithered greyscale driving scheme to be used.

1 Claim, 5 Drawing Sheets

OPTICAL MODULATOR AND INTEGRATED CIRCUIT THEREFOR

BACKGROUND AND SUMMARY OF THE INVENTION

This invention relates to an optical modulator, comprising a layer of an electro-optic material being provided between an integrated circuit and a light transmissive sheet. It also relates to an integrated circuit for use in such a modulator and a driving scheme for such a modulator.

Such optical modulators are known as silicon backplane modulators when the integrated circuit used comprises a silicon chip, but any semiconducting or semi-insulating material can form the body comprising the integrated circuit.

Liquid crystal silicon backplane devices are optical modulators of the above type in which the electro-optic layer comprises a liquid crystal layer provided directly on top of a silicon memory chip. A fuller description of these devices is contained in other documents such as EP-A-548180 and EP-11-548179. The integrated circuit is usually either an SRAM (static random access memory) type or a DRAM (dynamic random access memory) type, although other types of circuit are possible. There are many implementations of the silicon backplane device using an SRAM substrate, but all tend to have at least the basic structure shown schematically in FIGS. 1 and 2. FIG. 1 shows a block diagram of the silicon backplane. It consists of 2 shift registers one of which is connected to the 'data' lines and one of which is connected to the 'enable' lines, via latches, of the SRAM array. Serial data is fed into the shift registers and 'clocked' along until the whole shift register is filled with valid data. The valid data is then written into the array of SRAM elements when the latches on the enable lines are enabled. It is usual that only one row of the SRAM array is enabled and the rest of the rows disabled so that data is written into the rows a line at a time. Data is then loaded into the shift registers for another row in the SRAM array.

FIG. 2 shows the block diagram of an SRAM pixel. The SRAM block output is either held high or low depending on the data that was last loaded into the SRAM. Data can only be loaded in when the enable line is held high. When the enable line is low any data presented at the input is ignored. Often there is an exclusive 'OR' gate (XOR) between the liquid crystal element and the SRAM element so that the output from the SRAM can be easily inverted by an 'invert' signal without needing to reload the inverted data into the SRAM. This is useful if the electro-optic material is a ferroelectric liquid crystal which requires charge balanced drive pulses. The invert signal is usually a 'global' signal in that all the 'invert' signals are connected together, so that all the pixels are inverted simultaneously.

If a ferroelectric liquid crystal (FLC) is used, its bistable-memory effect degrades unless the applied electric fields are dc balanced on average. This is normally achieved by writing a frame of information and then inverting this image (using the global invert signal) and displaying it for the same period of time as the original, non-inverted image, so dc balancing every pixel over a period of 2 frames. If the device is illuminated during both these time periods, then obviously the image 'washes out'. To avoid this, the illumination source is modulated so that the device is not illuminated during the time the inverted image is displayed. Clearly this reduces the amount of time for which the image can be usefully displayed and so the average brightness is relatively low.

As the silicon backplane usually only produces positive voltages O–Vd (Vd usually=5 V), the dc compensating negative voltage is generated by either holding the front electrode at Vd/2 (so that the liquid crystal experiences both positive and negative voltages) during both frames, or by holding the front electrode at 0 V during the writing of the non-inverted image and then holding it at 5 V during the writing of the inverse image.

The liquid crystal can either experience just one voltage polarity in one frame or both polarities in one frame but at half the voltage. Since the switching speed of most ferroelectric liquid crystals are very sensitive to the applied voltage (if the applied voltage is reduced from say 5 V to 2.5 V the switching speed can halve or worse.) it is preferable to operate the device with the higher voltages so that the devices can be operated at fast frame rates so that time-dither greyscale can be used. However, if an efficient time dither greyscale is used (such as that described in EP-261901) then this requires both positive and negative voltages to be applied within the same frame. This is not possible with the present design of silicon backplane devices. The invention aims to alleviate this problem.

According to a first aspect of the invention, there is provided an optical modulator comprising a layer of an electro-optic material being provided between an integrated circuit and a light transmissive sheet. The integrated circuit carries electrodes which cooperate with selected regions of said layer, the electrodes being addressed in use with data according to an addressing sequence, which sequence is repeated in successive time periods. The light transmissive sheet carries one or more light transmissive electrodes. The optical modulator includes means for providing both a positive and a negative voltage across said layer in a given time period. The optical modulator includes means for providing a plurality of voltage pulses to the one or more light transmissive sheet in a given time period.

The above optical modulator further includes drive means for providing a plurality of positive voltage pulses and a plurality of negative voltage pulses across said layer in a given time period. Also, the integrated circuit carrying the electrodes is provided with a first plurality of row conductors each coupled to a subset of said electrodes and a further plurality of column conductors each coupled to a different subset of said electrodes. Means are provided to provide different patterns of voltage pulses during a said time period to different members of both the first plurality or row conductors and the further plurality of column conductors.

Advantageously, the electro-optic material is stable in a of states having respective optical properties. Further advantageously, the electro-optic material comprises a ferroelectric liquid crystal.

According to a second aspect of the invention there is provided an integrated circuit for use in the above optical modulator. In the integrated circuit, the means to provide different patterns of voltage pulses comprises a pair of shift registers each having a plurality of outputs, respective shift registers being capable of being coupled in use to respective members of said first plurality of row conductors or said further plurality of column conductors. Alternatively, the means to provide different patterns of voltage pulses comprises a row decoder and a column decoder, the decoders being capable of being coupled in use to respective members of said first plurality of row conductors or said further plurality of column conductors.

According to a third aspect of the invention there is provided a driving scheme for an optical modulator in which a method addressing an electro-optic modulator having an integrated circuit forming a boundary on one side of the electro-optic layer and a light transmissive substrate carrying one or more light transmissive electrodes on the other side of the electro-optic layer, includes the step of applying a plurality of voltage pulses in a given frame time period to the electrode(s) being carried by the light transmissive substrate. Advantageously, each of the plurality of voltage pulses have the same polarity.

DETAILED DESCRIPTION OF THE DRAWINGS

Figure 1:
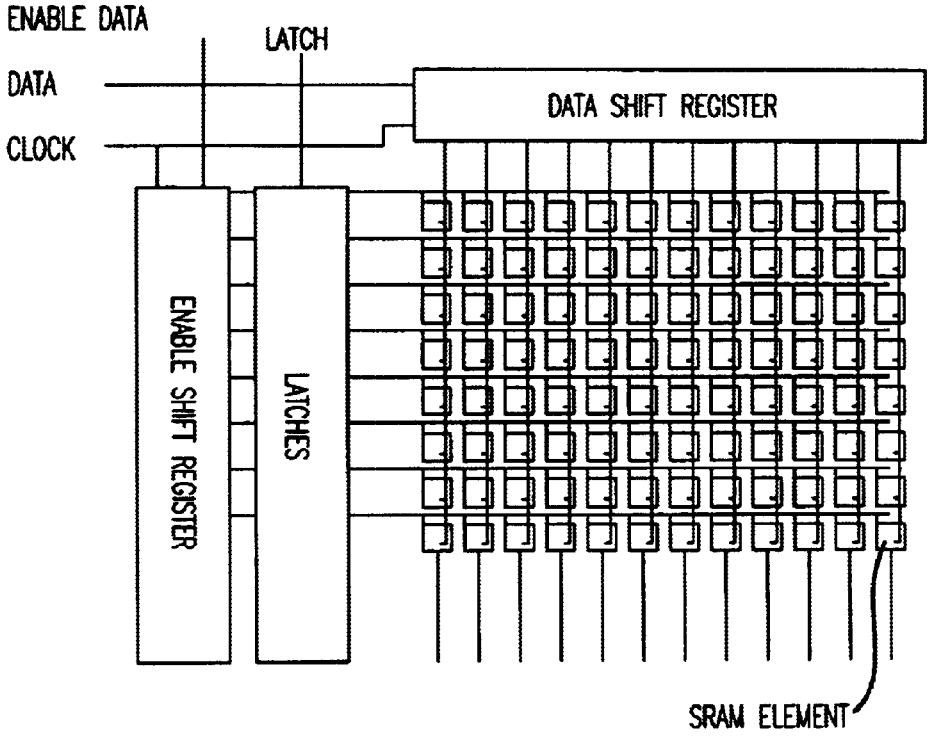
FIG.1 PRIOR ART
FIG. 1 is a schematic block diagram of a conventional silicon back plane.
Figure 2:
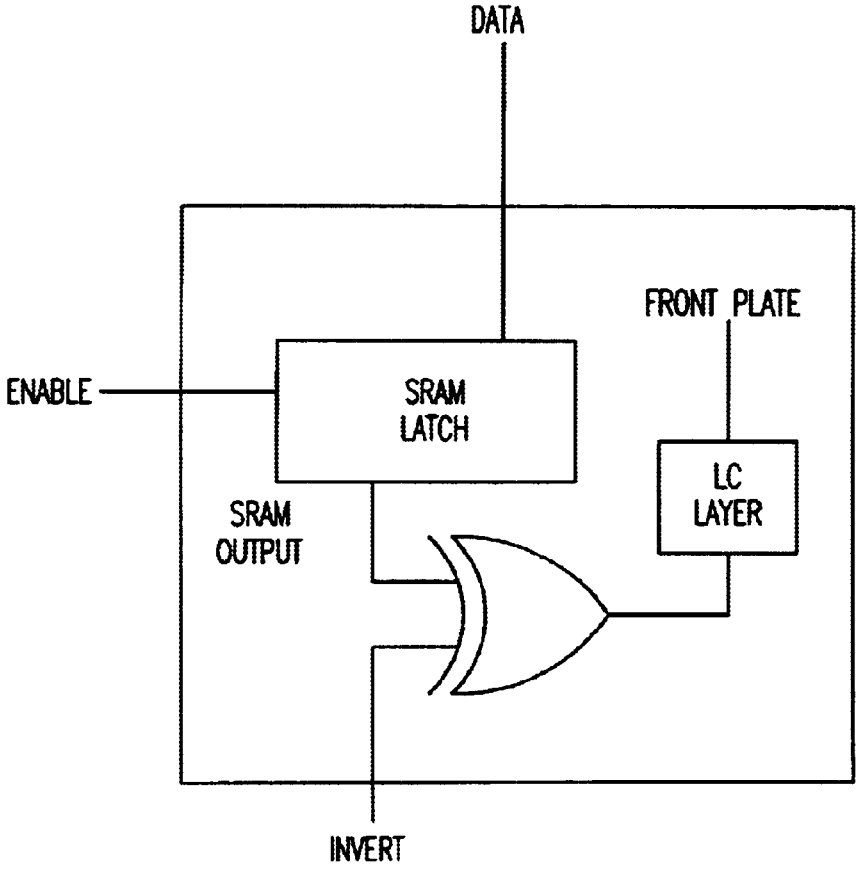
FIG.2 PRIOR ART
FIG. 2 is a schematic block diagram of an SRAM pixel element.
Figure 3:
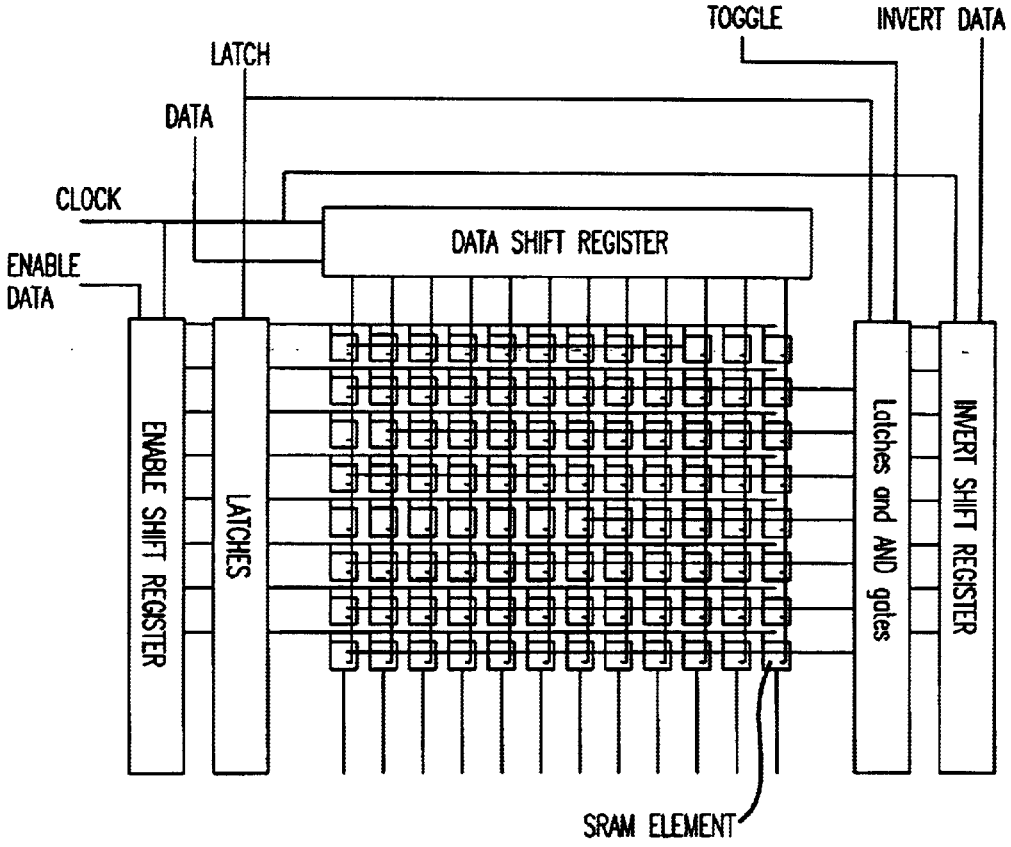
FIG. 3 is a schematic diagram of a silicon back plane according to the present invention.

This invention uses a modified design of silicon backplane to overcome the restriction of being unable to apply both positive and negative voltages at the same time on different pixels as well as being able to apply the maximum voltage (Vd) available. The difference in the design between the invention and the prior art, is that in the prior art the 'invert' lines for each row are commoned together, but in the invention, the invert line for each row is taken out to a separate row decoder or shift register (as shown in FIG. 3). This enables the set of waveforms shown in FIG. 4 to be applied across the FLC. The first row of waveforms are those that can be applied to the front electrode of the device; the second row of waveforms are those which can be applied to the silicon backplane; and the bottom row of waveforms are those which appear across the ferroelectric liquid crystal (FLC) and are the difference between the other two sets of waveforms.

We will now describe a novel way of line by line writing or addressing the pixels (picture elements) on such devices, so that temporal greyscale (such as that described in EP 261901) can be more easily implemented, and less dc compensation is required. Both of these advantages enable faster writing of images to the device.

In the present embodiment the electrode carried by the light transmissive sheet is unpatterned, and covers substantially the whole major surface, thus reducing fabrication costs. However, if desired, a patterned electrode structure may be used as an alternative. In the present embodiment; the electrode carried by the light transinissive sheet is light transmissive.

The front electrode is continuously switched by a square wave signal between 0 V and +Vd. The data on the columns of the backplane is either 'high' or 'low', and the 'invert' line on a particular row is either held 'low' or 'toggled' at the same frequency as the front electrode.

Figures 4A, 4B, 4C, 4D:
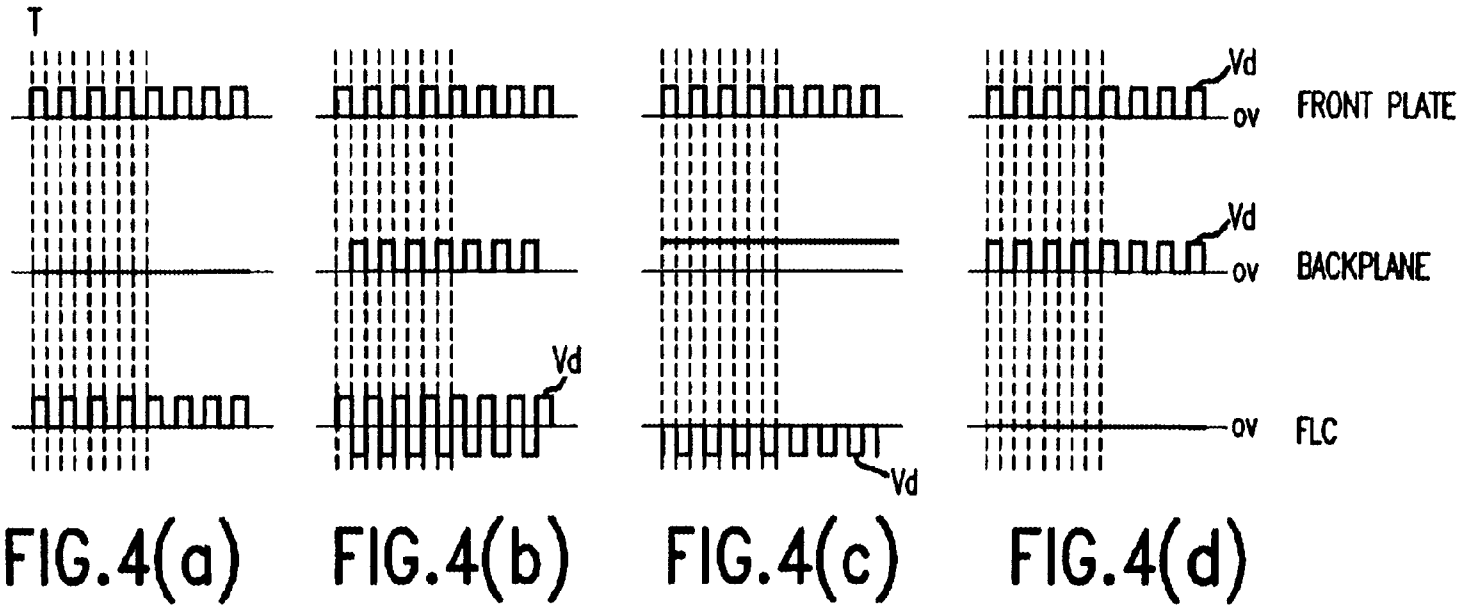
FIGS. 4*a–d* illustrate pixel waveforms in accordance with the present invention.

The first column of waveforms, FIG. 4(*a*), is when an 'On' signal is applied to the data lines in the silicon backplane (the actual voltage appearing at the pixel being 0 V), and the 'invert' line is not toggled; the second column of waveforms, FIG. 4(*b*), shows the same case as 4(*a*), but with the 'invert' line toggled. The third column of waveforms, FIG. 4(*c*), is when an 'Off' signal is applied to the data lines in the silicon backplane (the actual voltage appearing at the pixel is Vd), and the 'invert' line is not toggled; finally the last column, FIG. 4(*d*), is the same case as 4(*c*) but with the 'invert' line toggled.

Thus it is possible to produce both polarity signals simultaneously at any pixel and also apply waveforms (the pixel waveforms of columns (b) and (d) in FIG. 4) which will maintain the previously selected states but without applying any DC, thus reducing the amount of time needed to dc compensate the device.

Figure 5:
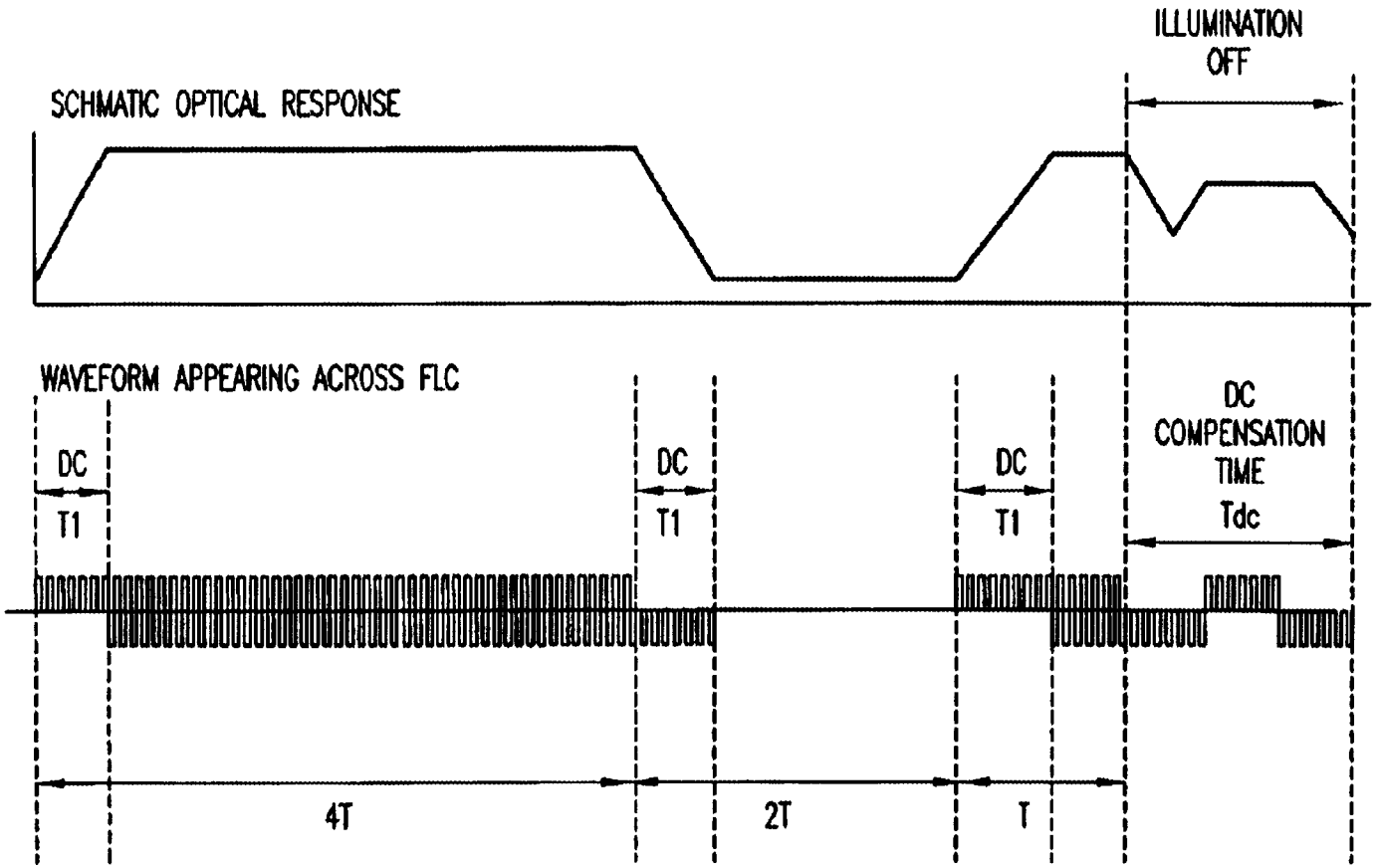
FIG. 5 illustrates how the pixel waveforms are used to implement a time dithered greyscale scheme.

FIG. 5 illustrates how the waveforms are used in implementing a time dithered greyscale scheme, like that detailed in patent application EP 261901, which is incorporated herein by reference. The example of FIG. 5 shows a 3 bit temporal greyscale scheme, where the 3 bits are written sequentially, starting with the most significant bit and ending with the least significant bit, and spaced apart in time, such that the time between successive bits being written in a given field period (or frame period for a monochrome display) is in the ratio 2:1.

In the first period of time the pixel is written with either an 'On' (as shown in FIG. 5) or an 'Off' signal, and the pixel experiences a certain amount of DC. Then the 'invert' line is toggled and the pixel experiences either an ac signal, if the pixel is written with 'On' data, or zero volts if it is written with 'Off' data. The FLC does not switch during this time as it is bistable. This state continues until the pixel is re-written with the next bit of data, when the process is repeated. The time that is allowed for the pixel to experience the dc switching waveform is just long enough to allow the FLC to switch, and is usually a small fraction of the frame time. From FIG. 5 it will be seen that the frame time is 7T. The ratio of successive time periods labelled T, 2T and 4T are in accordance with a binary weighted addressing scheme in which these three periods are addressed with data having different significances, as explained in EP-261901. The time the pixel experiences dc is 3T1, and the dc compensation period Tdc is also 3T1. Consequently, as 7T>>3T1, there is less time spent dc compensating than in some prior art methods which require a whole frame time (i.e. 7T in this case) to effect dc compensation.

Although the above embodiments of the invention use a ferroelectric liquid crystal material as the electro-optic layer, other electro-optic materials such as ceramics or antiferroelectric materials may be used as an alternative. It is important that whatever layer of electro-optic material is used is sensitive to the polarity of the voltage being applied across it.

What is claimed is:

1. An optical modulator integrated circuit structure, comprising:

a light transmissive sheet including at least one light transmissive electrode wherein all of said at least one light transmissive electrode are connected together in common in order to output a common voltage at the same time;

an optical modulator including a layer of an electro-optic material having a means for providing both a positive and negative voltage across said layer in a frame period and a means for providing a plurality of voltage pulses to said commonly connected at least one transmissive electrode of said light transmissive sheet in a first given time period;

an integrated circuit including electrodes which cooperate with selected regions of said layer, wherein said integrated circuit electrodes are addressed with data according to an addressing sequence, wherein said sequence is repeated in successive time periods and wherein said integrated circuit includes a first plurality of row conductors each coupled to a first subset of said electrodes and a second plurality of column conductors each coupled to a second subset of said electrodes, said integrated circuit further including means to provide different patterns of voltage pulses during a second given time period to different ones of said first plurality of row conductors and said second plurality of column conductors wherein the means to provide different patterns of voltage pulses include a row decoder and a column decoder wherein said row and column decoders are coupled to a respective one of said first plurality of row conductors and said second plurality of column conductors; and wherein said layer of electro-optic material is provided between said integrated circuit and said light transmissive sheet thereby enabling line by line addressing.

* * * * *